United States Patent [19]

Knoblock et al.

[11] Patent Number: 4,872,635

[45] Date of Patent: Oct. 10, 1989

[54] SLIP CONNECTOR FOR WEIGHT ACTUATED HEIGHT ADJUSTORS

[75] Inventors: Glenn A. Knoblock, Kentwood; Brian L. Scolten, Jenison, both of Mich.

[73] Assignee: Steelcase Inc., Grand Rapids, Mich.

[21] Appl. No.: 91,585

[22] Filed: Aug. 31, 1987

Related U.S. Application Data

[62] Division of Ser. No. 850,510, Apr. 10, 1986, Pat. No. 4,709,894.

[51] Int. Cl.[4] ..... A47C 3/24

[52] U.S. Cl. ..... 248/406.2; 297/349

[58] Field of Search ..... 248/405, 406.1, 406.2, 248/415, 417, 418; 297/345, 349

[56] References Cited

U.S. PATENT DOCUMENTS

| | | | |
|---|---|---|---|
| 1,160,108 | 11/1915 | Hasty | 248/406.1 |
| 1,334,660 | 3/1920 | Loeffler | 248/406.1 |
| 1,578,784 | 3/1926 | Walton | 248/417 |
| 2,137,178 | 11/1938 | Merivaara | 248/418 |
| 2,987,110 | 6/1961 | Cramer, Jr. | 155/93 |
| 3,227,113 | 1/1966 | Kupski | 108/148 |
| 3,778,014 | 12/1973 | Driscoll et al. | 248/406 |
| 3,799,485 | 3/1974 | Wolters | 248/406 |
| 3,799,486 | 3/1974 | Mohr et al. | 248/406 |
| 3,856,252 | 12/1974 | Regis | 248/402 |
| 3,870,271 | 3/1975 | Bowman | 248/406 |
| 3,991,965 | 11/1976 | Westover et al. | 248/406.2 |
| 4,087,071 | 5/1978 | Parker | 248/406 |
| 4,181,280 | 1/1980 | Bowman | 248/405 |
| 4,234,152 | 11/1980 | Browse | 248/406.2 |
| 4,253,632 | 3/1981 | Doerner | 248/405 |
| 4,261,540 | 4/1981 | Baker et al. | 248/406.2 |
| 4,285,488 | 8/1981 | Hancock | 248/405 |
| 4,315,613 | 2/1982 | Goodwin et al. | 248/406.2 |
| 4,324,382 | 4/1982 | Beukema et al. | 248/406 |
| 4,379,540 | 4/1983 | French | 248/406 |
| 4,394,001 | 7/1983 | Winiewski | 248/406.2 |
| 4,440,372 | 4/1984 | Wisniewski | 248/406 |
| 4,493,469 | 1/1985 | Holobaugh | 248/406.1 |
| 4,494,721 | 1/1985 | Trinkel et al. | 248/406.2 |
| 4,540,148 | 9/1985 | Jann | 248/406.2 |
| 4,598,892 | 7/1986 | Franckowiak et al. | 248/406.2 |

FOREIGN PATENT DOCUMENTS

| | | | |
|---|---|---|---|
| 840197 | 7/1960 | United Kingdom | 248/417 |
| 1078215 | 8/1967 | United Kingdom | 248/406.1 |
| 2065462 | 7/1981 | United Kingdom | 248/406.2 |

*Primary Examiner*—Ramon O. Ramirez
*Assistant Examiner*—Robert A. Olson
*Attorney, Agent, or Firm*—Price, Heneveld, Cooper, DeWitt & Litton

[57] ABSTRACT

A slip connector is provided for swivel chairs, and other similar seating, of the type having a base, a seat rotatably supported thereon, and a weight actuated height adjustor, which engages when the seat is unoccupied to facilitate adjusting the seat height, and disengages when the seat is occupied to permit the seat to swivel on the base without affecting the seat height. The slip connector includes two coupling members, which rotate about a common axis when the seat swivels about the base. A stop mechanism positively interconnects the coupling members causing them to rotate together when they assume a first, angular relationship. A spring interconnects the coupling members, and biases the same when the seat is unoccupied into a second angular relationship, which is spaced a preselected angular measure from the first angular relationship, such that when the user exits the seat, the seat must be rotated through the preselected angular measure before the seat height can be adjusted, thereby greatly alleviating any unintentional height adjustment.

11 Claims, 8 Drawing Sheets

FIG. 3
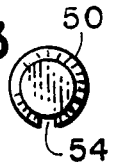
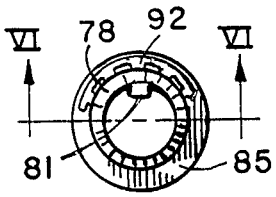
FIG. 5
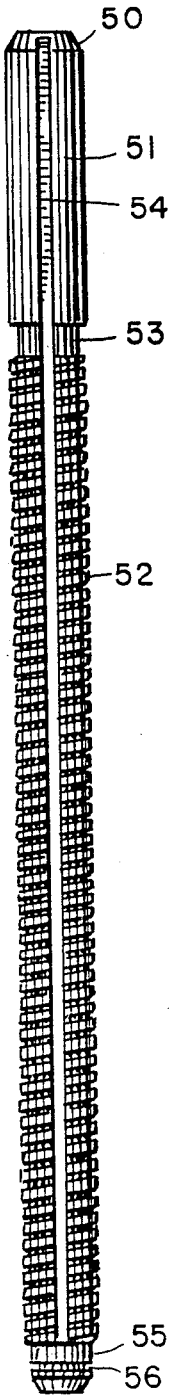
FIG. 4
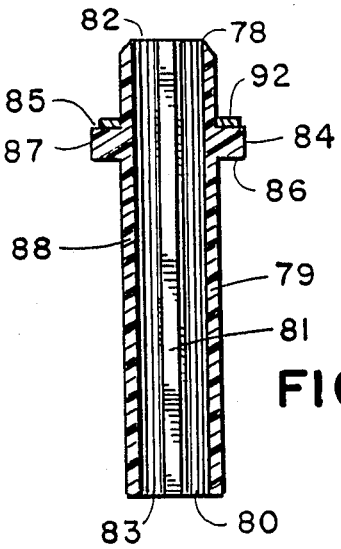
FIG. 6
FIG. 9
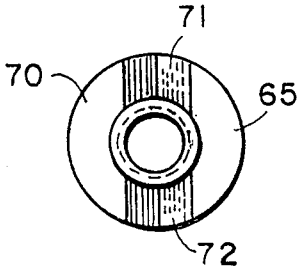
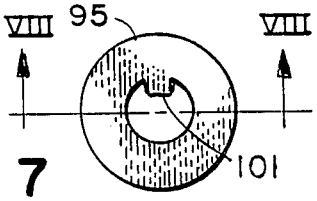
FIG. 7
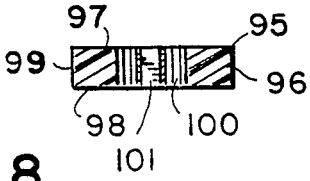
FIG. 8
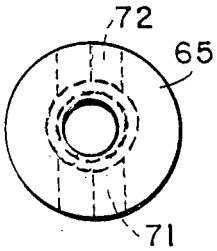
FIG. 10
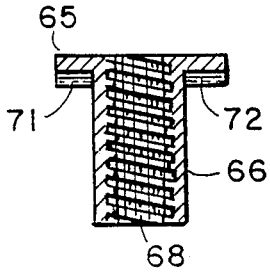
FIG. 12
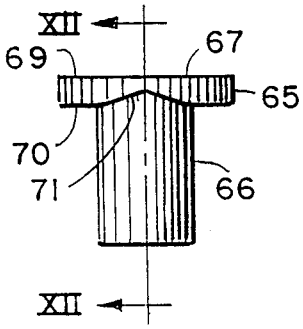
FIG. 11

A8 ↑

SLIP CONNECTOR FOR WEIGHT ACTUATED HEIGHT ADJUSTORS

BACKGROUND OF THE INVENTION

The present invention relates to seating and the like, and in particular to weight actuated height adjustors therefor.

A wide variety of furniture articles, such as tables, seating, and the like, employ an adjustment mechanism to vary the height of a selected portion of the furniture article. For example, in seating, a height adjustor is used to vary the height of the seat above the base, so as to accommodate or adjust the seating for different users and tasks.

Weight actuated height adjustors, such as the device disclosed in U.S. Pat. No. 4,324,382 to Beukema et al., which is assigned to the assignee of the present application, have been used- in seating, particularly swivel chairs and tilt back chairs, that are designed for use primarily in office environments. Such weight actuated height adjustors typically engage only when the chair is unoccupied, and adjustment of the seat height is achieved by rotating or swiveling the chair with respect to the base. When the chair is occupied, the height adjustor typically disengages to permit the chair to swivel about the base without affecting the selected seat height.

Heretofore, chairs with weight actuated height adjustors have had a tendency to slowly drop downwardly from their selected height setting. If the user quickly exits the chair with a twisting motion, as can be experienced when the user exits the chair from a forward facing, sitting position at a desk, or other similar work surface, the chair may tend to continue swiveling or rotating after the user's weight is removed from the seat. This additional swiveling motion or "run-on" rotation can cause a slight change in the selected height of the seat.

Furthermore, when the user returns to his or her station, the user sometimes rotates the chair to a selected entry position before the user sits down. This type of action can also result in some slight, unintentional adjustment of the selected seat height.

Over a relatively long period of time, the circumstances outlined above, as well as other similar activities, can cause the chair to continuously move or adjust downwardly, until the chair is so far out of adjustment that it must be readjusted. Such unintentional height adjustment can prove to be rather frustrating, particularly in those situations and tasks where the user continuously moves in and out of the chair. Furthermore, since the unintentional adjustment occurs in very slight increments, the user often does not realize that the chair height needs to be readjusted until it has reached a very uncomfortable position, thereby detracting from the overall comfort of the chair.

SUMMARY OF THE INVENTION

One aspect of the present invention is to provide a slip connector for weight actuated height adjustors, and the like, which greatly alleviates any unintentional height adjustment or other movement from a selected height position. The slip connector includes two coupling members which rotate about a common axis when the seat swivels on the base. A stop mechanism positively interconnects the coupling members, causing them to rotate together when they assume a first angular relationship. A spring mechanism interconnects the coupling members, and biases the same each time the seat is occupied into a second angular relationship, which is spaced a preselected angular measure from the first angular relationship, such that when the user exits the seat, the seat must be rotated through the preselected angular measure before the seat height can be adjusted. Hence, any slight run-on rotation of the chair after the user exits the same, or any minor rotation of the chair prior to sitting down in the chair will not result in any change in the selected chair height.

The principal objects of the present invention are to provide a mechanism for weight actuated height adjustors, which will prevent and/or greatly alleviate any unintentional height adjustment. The present invention comprises a slip connector, which is particularly well adapted for swivel chairs, tilt back chairs, and other similar seating articles. The slip connector is efficient in operation, yet has relatively few moving parts, with an uncomplicated construction that achieves a high level of reliability. The slip connector is efficient in use, economical to manufacture, capable of a long operating life, and particularly well adapted for the proposed use.

These and other features, advantages and objects of the present invention will be further understood and appreciated by those skilled in the art by reference to the following written specification, claims and appended drawings.

BRIEF DESCRIPTION OF THE DRAWINGS

FIG. 3 is a top plan view of an adjustment screw portion of the height adjustor.

FIG. 4 is a front elevational view of the adjustment screw.

FIG. 5 is a top plan view of a spring guide portion of the height adjustor.

FIG. 6 is a vertical cross-sectional view of the spring guide, taken along the line VI—VI of FIG. 5.

FIG. 7 is a top plan view of an adjustment washer portion of the adjustor.

FIG. 8 is a vertical cross-sectional view of the adjustment washer taken along the line VIII—VIII of FIG. 7.

FIG. 9 is a bottom plan view of an adjustment nut portion of the height adjustor.

FIG. 10 is a top plan view of the adjustment nut.

FIG. 11 is a side elevational view of the adjustment nut.

FIG. 12 is a vertical cross-sectional view of the adjustment nut, taken along the line XII—XII of FIG. 11.

DETAILED DESCRIPTION OF THE PREFERRED EMBODIMENTS

Figures 1, 2:
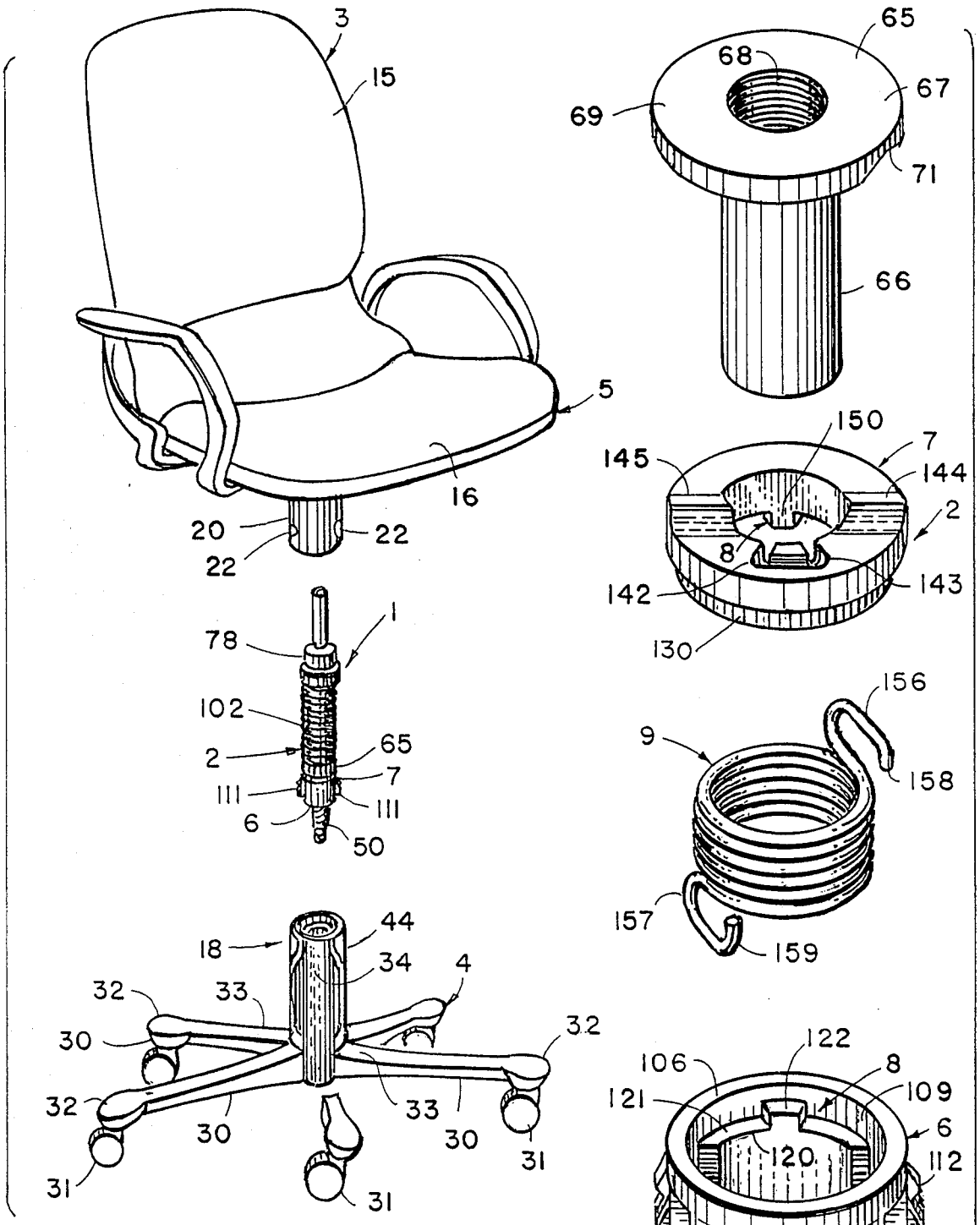
FIG. 1 is an exploded, perspective view of a chair having a height adjustor, and a slip connector therefor which embodies the present invention.
FIG. 2 is an enlarged, exploded perspective view of the slip connector.
Figure 13:
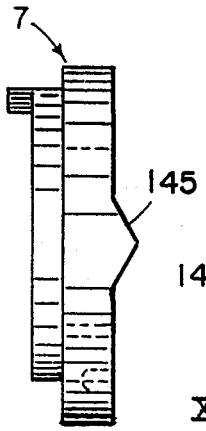
FIG. 13 is a left-hand side elevational view of a cam portion of the slip connector.
Figure 14:
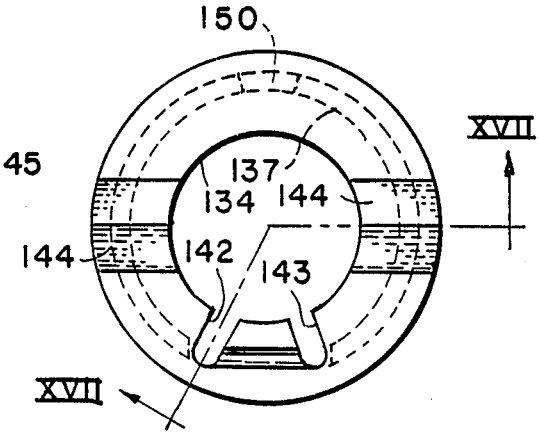
FIG. 14 is a top plan view of the cam.
Figure 15:
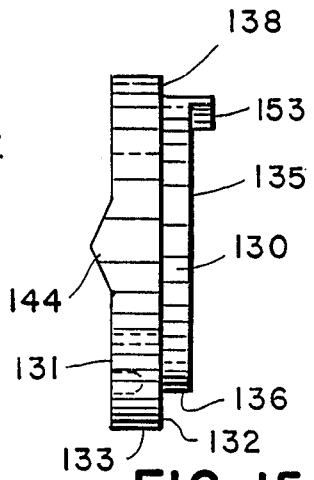
FIG. 15 a right-hand side elevational view of the cam.

For purposes of description herein, the terms "upper," "lower," "right," "left," "rear," "front," "vertical," "horizontal," and derivatives thereof shall relate to the invention as oriented in FIG. 1, and with respect to the seated user. However, it is to be understood that the invention may assume various alternative orientations, except where expressly specified to the contrary. It is also to be understood that the specific devices and processes illustrated in the attached drawings, and described in the following specification, are simply exemplary embodiments of the inventive concepts defined in the appended claims. Hence, specific dimensions, and other physical characteristics relating to the embodiments disclosed herein are not to be considered as limiting, unless the claims by their language, expressly state otherwise.

The reference numeral 1 (FIG. 1) generally designates a height adjustor assembly, having a slip connector 2 embodying the present invention. Height adjustor assembly 1 is adapted for use in conjunction with a wide variety of furniture articles, particularly seating, such as the illustrated swivel tilt chair 3. Chair 3 includes a base 4, a seat 5 rotatably mounted on base 4, and incorporates height adjustor assembly 1, which engages when seat 5 is unoccupied to facilitate adjusting the seat height, and disengages when seat 5 is occupied to permit the seat to swivel without affecting the seat height. Slip connector 2 includes two coupling members 6 and 7 (FIG. 2), which rotate about a common axis when seat 5 is rotated with respect to base 4. A stop mechanism 8 positively interconnects coupling members 6 and 7 causing them to rotate together when they assume a first angular relationship. A spring 9 interconnects coupling members 6 and 7, and biases the same when seat 5 is occupied into a second angular relationship, which is spaced a preselected angular measure from the first angular relationship, such that when the user exits seat 5, the seat must be rotated through the preselected angular measure before the seat height can be adjusted, thereby greatly alleviating any unintentional height adjustment.

Height adjustor assembly 1 can be used in conjunction with a wide variety of different types of furniture articles, but in the illustrated example, is shown used in conjunction with a unique, new chair, which is the subject of co-pending patent application Ser. No. 850,268, filed Apr. 10, 1986, and entitled *INTEGRATED CHAIR AND CONTROL.* The illustrated chair 3 includes an integral seat construction, comprising a back rest or chair back 15 and a seat or chair bottom 16. A control 17 (FIGS. 28 and 29), a major portion of which is not illustrated herein, connects seat 5 with base 4 in a manner which permits seat 5 to swivel with respect to base 4, and also permits chair back 15 to tilt rearwardly. A cylindrically shaped column assembly 18 is securely mounted in a mating socket 19 in control 17, and extends vertically downwardly from chair bottom 16. Column assembly 18 includes two, concentrically positioned, rigid tubular columns 20 and 21. The outer column 20 extends from control 17 downwardly to a location adjacent to the bottom of base 4. A pair of windows or cutouts 22 are positioned in the lower portion of outer column 20 on diametrically opposed sides thereof, and facilitate connecting height adjustor assembly 1 to outer column 20. The inner column 21 is positioned within the upper portion of outer column 20, and is adjacent thereto. Inner column 21 extends from control 17 downwardly to a medial portion of outer column 20, and includes an annularly shaped end cap 23 that forms a lip or shoulder 24 along its lower surface.

With reference to FIG. 1, the illustrated chair base 4 includes five radially extending legs 30, which have casters 31 mounted at the outer, enlarged ends 32 of legs 30. The inner ends 33 of base legs 30 are fixedly attached to a rigid, cylindrically shaped support tube 34. The lower end 35 (FIGS. 28 and 29) of support tube 34 extends below the lower edges of base legs 30, and includes a disc shaped end plate 36 fixedly mounted therein by suitable means such as welding or the like. End plate 36 includes a central aperture 37 therethrough for purposes to be described in greater detail hereinafter.

The upper end 40 of support tube 34 is positioned a selected spaced apart distance from chair bottom 16, and includes a sleeve shaped bearing 41 mounted therein. Bearing 41 is closely received within support tube 34, and includes an upper lip 42, which abuts the upper edge 43 of support tube 34. A cover tube 44 (FIG. 1) is positioned outside of support tube 34, concentric therewith, and is attached to the upper surfaces of base legs 30. Cover tube 44 extends from base legs 30 upwardly to a position adjacent to chair bottom 16, and serves to conceal or cover the hub area of base 4.

With reference to FIGS. 3 and 4, height adjustor assembly 1 includes an elongate adjustment screw 50. Adjustment screw 50 includes a non-threaded, upper end portion 51, a threaded, lower end portion 52, and an annular groove 53 positioned therebetween. A rectangularly shaped keyway 54 extends along the length of adjustment screw 50 for purposes to be described in greater detail hereinafter. The lower end portion 52 of adjustment screw 50 includes a shouldered stud 55 which is shaped to be received in the central aperture 37 of support tube end plate 36 to support adjustment screw 50 centrally within support tube 34. A retainer groove 56 and mating snap ring 57 (FIGS. 28 and 29) securely interconnect adjustment screw 50 with support tube end plate 36. In the illustrated example, the threads on the lower end portion 52 of adjustment screw 50 are an Acme type, with a double lead right-hand turn.

Height adjustor assembly 1 also includes an adjustment nut 65 (FIGS. 9–11) which is adapted to threadingly engage adjustment screw 50. Adjustment nut 65 has a generally cylindrically shaped body 66 with an enlarged, disc shaped head or flange 67 at the upper end thereof. A threaded aperture 68 extends axially through adjustment nut body 66, with the threads being of the same, Acme double lead type to mate with the lower end portion 52 of adjustment screw 50. The upper surface 69 of adjustment nut flange 67 is substantially flat, and has a circular plan configuration. The lower surface 70 of adjustment nut flange 67 includes two, radially oriented grooves 71–72. Grooves 71–72 have an inverted V-shaped transverse crosssectional configuration, and are arranged radially in a diametrically opposed relationship.

Height adjustor assembly 1 further includes a spring guide 78 (FIGS. 5 and 6), which has a generally cylindrically shaped body 79, with a non-threaded, smooth central aperture 80 therethrough in which adjustment screw 50 is closely received. A rectangularly shaped key 81 extends radially inwardly from the surface of central aperture 80, and is shaped for close reception in the keyway 54 on adjustment screw 50. Spring guide 78 includes upper and lower ends 82 and 83, and an integrally formed, annularly shaped collar portion 84 disposed generally adjacent to the upper end 82 of spring guide 78. Collar portion 84 includes upper and lower surfaces 85 and 86, as well as a marginal edge 87 spaced radially outwardly from the outer surface 88 of spring guide 78.

An annularly shaped bearing 92 (FIGS. 5 and 6) is positioned over the upper end 82 of spring guide 78, and rests on the upper surface 85 of collar portion 84. Bearing 92 is adapted to abut the lower surface 24 (FIGS. 28 and 29) end cap 23 on inner columns 21, and permits sliding rotation between spring guide 78 and column assembly 18.

Height adjustor assembly 1 also includes an adjustment washer 95 (FIGS. 7 and 8), which has a generally annularly shaped body 96, with upper and lower surfaces 97 and 98, and a peripheral edge 99. Adjustment washer body 96 includes a non-threaded, smooth central aperture 100 therethrough, which is shaped to closely receive adjustment screw 50 therethrough. A rectangularly shaped key 101 extends radially inwardly from the interior surface of washer aperture 100, and is aligned with the longitudinal axis thereof to be received in the keyway 54 on adjustment screw 50.

Height adjustor assembly 1 also includes a compression spring 102 (FIGS. 28 and 29), with opposite ends 103 and 104, which when deflected generate an associated reaction force therebetween. The illustrated spring 102 is a coil spring, which fits closely on the body portion 79 of spring guide 78. In the untensed state, the length of spring 102 is longer than the length of that portion of spring guide 78 disposed between collar surface 86 and end edge 83 to provide a maximum seat drop or cushion of approximately $\frac{3}{8}$–$\frac{3}{4}$inches, as described below.

The illustrated slip connector 2 comprises a three-piece assembly, wherein coupling member 6 comprises a retainer. As best illustrated in FIGS. 21–24, retainer 6 has a generally cylindrically shaped body 105, with upper and lower edges 106 and 107, and a cylindrically shaped sidewall 108 with interior and exterior surfaces 109 and 110 respectively. A pair of three pronged barb assemblies 111 are mounted on the exterior surface 109 of retainer 6, and are positioned on diametrically opposite sides thereof. The prongs 112 of barb assemblies 111 are resiliently flexible, and snap into the mating cutouts 22 in outer column 20 to mount retainer 6 securely in column assembly 18, such that retainer 6 rotates with chair 3 as it swivels about base 4. The upper end of retainer 6 is hollow, and the lower end of retainer 6 includes a central aperture 113, which together permit adjustment screw 50 to extend through the central portion of retainer 6. The lower edge 107 of retainer 6 includes a notch 114 and an aperture 115 in which one end of spring 9 is mounted, as described in greater detail below.

The stop mechanism 8 includes a ledge 120 which extends radially outwardly from the interior surface 109 of retainer sidewall 108, along a portion of one side thereof. Ledge 120 includes an upper surface 121, and an integrally formed stop post 122 located adjacent to the center of ledge 120, and extending from the upper surface 121 thereof to a location disposed slightly below the upper edge 106 of retainer sidewall 108. Annular spaces 123 and 124 are thereby formed on the opposite sides of stop post 122 directly above ledge 120, and define grooves in which another mating portion of stop mechanism 8 selectively rotates, as described hereinafter.

With reference to FIGS. 13–18, the illustrated coupling member 7 comprises a cam having a generally cylindrically shaped body 128, with a disc shaped upper portion 129, and a lower, annularly shaped collar portion 130. The upper portion 129 of cam 7 includes an upper surface 131, a lower surface 132, a perimeter edge 133, and a non-threaded, smooth central aperture 134 extending therethrough. The lower collar portion 130 of cam 7 extends downwardly from the lower surface 132 of upper cam portion 129, and includes a lower edge 135, a perimeter edge 136, and a central aperture 137. The perimeter edge 136 of lower cam portion 130 is disposed radially inwardly from the perimeter edge 133 of upper cam portion 129, so as to form an annularly shaped ledge 138. The upper surface 131 of upper cam portion 129 includes a pair of radially oriented slots 142 and 143, in which the upper end of spring 9 is mounted, as described in greater detail hereinafter. The upper surface 131 of cam 7 also includes two detents, in the form of radially positioned, upstanding ribs or teeth 144–145. The illustrated teeth 144–145 are identical in shape, and mate with detent grooves 71–72. In the illustrated example, detent teeth 144–145 have an inverted, V-shaped transverse cross-sectional configuration. The two detent teeth 144–145 are arranged in the same, diametrically opposed pattern as detent grooves 71–72.

Stop mechanism 8 further includes a stop lug 150 (FIGS. 13–18), which is adapted to selectively engage or abut stop post 122 to cause retainer 6 and cam 7 to rotate together. In the illustrated example, stop lug 150 is integrally formed with and projects downwardly from the lower collar portion 130 of cam 7, and has an arcuate bottom plan shape. Stop lug 150 includes side edges 151 and 152, and a lower edge 153.

Figure 19:
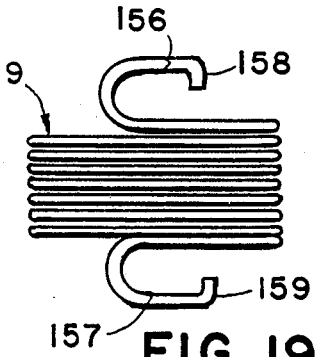
FIG. 19 is a side elevational view of a spring portion of the slip connector.
Figure 16:
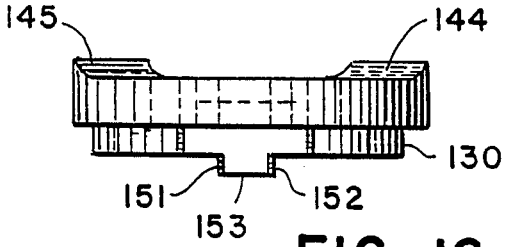
FIG. 16 is a front elevational view of the cam.
Figure 17:
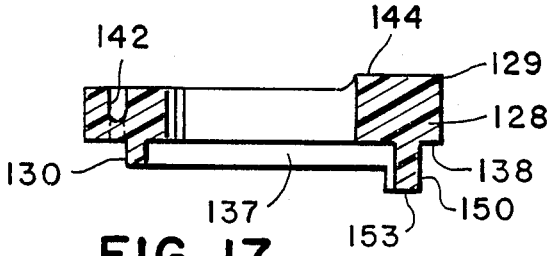
FIG. 17 is a vertical cross-sectional view of the cam, taken along the line XVII—XVII of FIG. 14.
Figure 20:
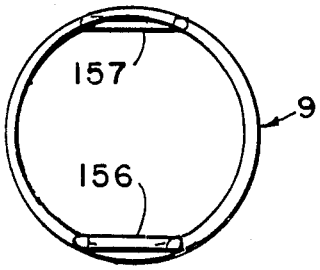
FIG. 20 is a top plan view of the spring.
Figure 18:
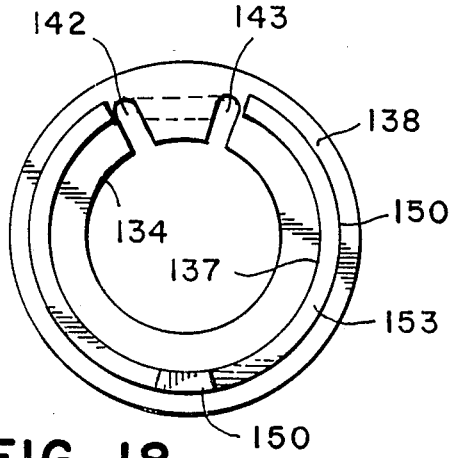
FIG. 18 is a bottom plan view of the cam.
Figure 21:
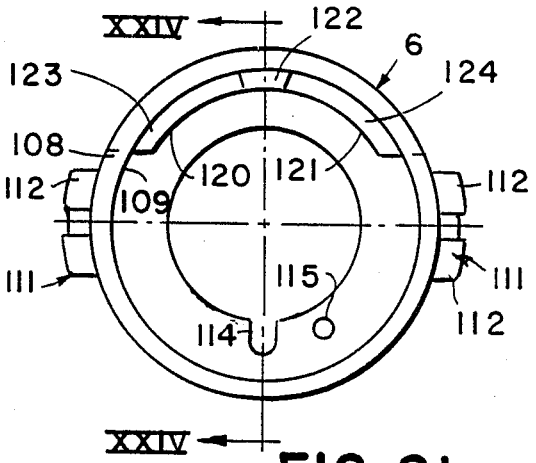
FIG. 21 is a top plan view of a retainer portion of the slip connector.
Figure 22:
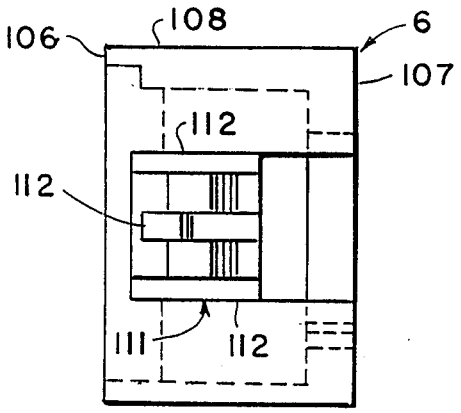
FIG. 22 is a side elevational view of the retainer.
Figure 23:
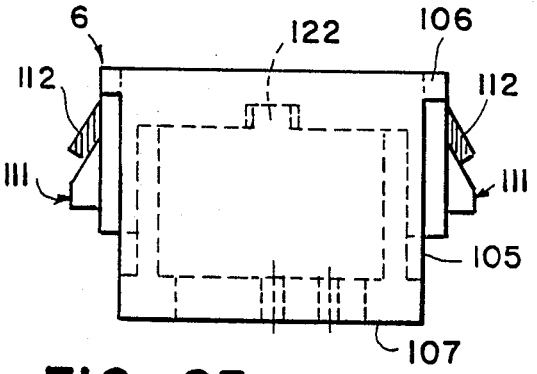
FIG. 23 is a front elevational view of the retainer.
Figure 24:
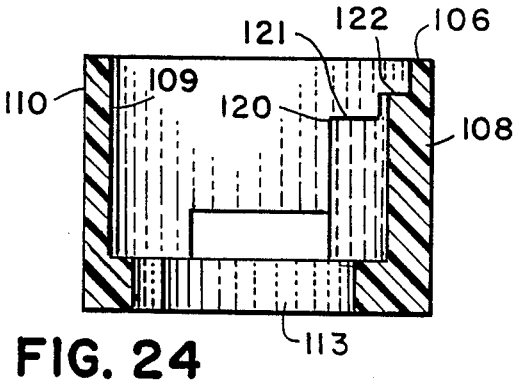
FIG. 24 is a vertical cross-sectional view of the retainer, taken along the line XXIV—XXIV of FIG. 21.

Spring 9 (FIGS. 19 and 20) comprises a coil spring, having opposite ends 156 and 157 adapted for torsional rotation therebetween. As best illustrated in FIG. 20, the ends 156 and 157 of spring 9 are located on diametrically opposite sides of spring 9 when spring 9 is in a normal, or untensed condition. Rotation of one of the spring ends 156 and 157 with respect to the other end, torsionally tenses spring 9, and thereby creates a couple, which resiliently biases the ends to their normal, diametrically opposed positions. The ends 156 and 157 of spring 9 include foot portions 158 and 159 for connecting spring 9 with slip connector 2.

Figure 26:
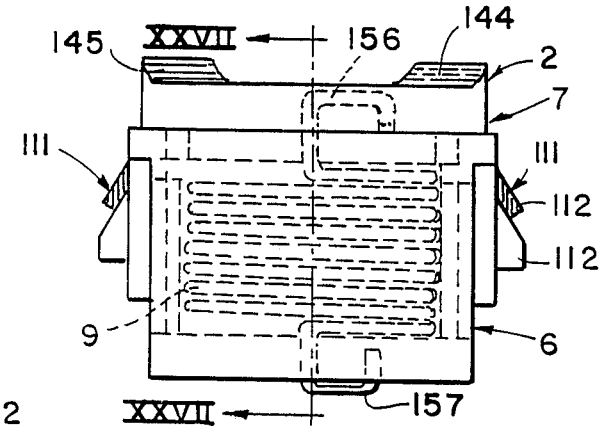
FIG. 26 is a side elevational view of the slip connector in an assembled condition.
Figure 25:
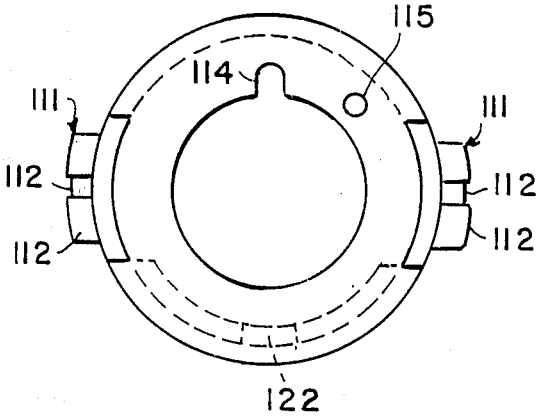
FIG. 25 is a bottom plan view of the retainer.
Figure 27:
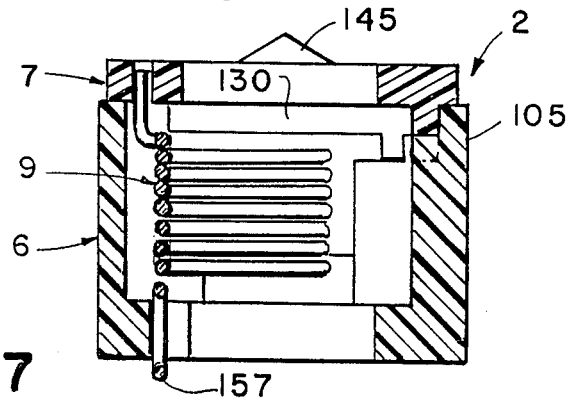
FIG. 27 is a vertical cross-sectional view of the assembled slip connector, taken along the line XXVII—XXVII of FIG. 26.
Figure 35:
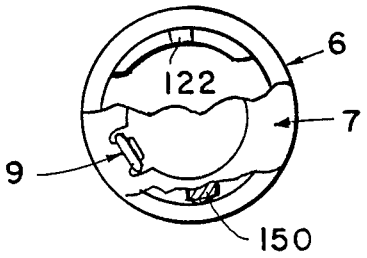
FIG. 35 is a top plan view of the slip connector, wherein portions thereof have been broken away to show mating stop members shown in a normal, fully disengaged angular relationship.

When assembled (FIGS. 26 and 27), cam 7 is placed on top of retainer 6, with the lower collar portion 130 of cam 7 disposed within retainer body 105, and the ledge portion 138 of cam 7 resting on the upper edge 106 of retainer 6. Cam collar 130 aligns retainer 6 and cam 7 to cause the same to rotate about a mutual, concentrically located axis. The upper end 156 of spring 9 is received in the mating slots 142 and 143 of cam 7. The lower end 157 of spring 9 is received in the mating notch 114 and aperture 115 of retainer 6. The ends 156 and 157 of spring 9 are spaced apart axially or longitudinally a distance that is slightly less than the corresponding engagement surfaces of retainer 6 and cam 7, such that spring 9 is stretched somewhat axially, and thereby resiliently biases retainer 6 and cam 7 together In the unstressed, normal condition of spring 9, stop lug 150 is located diametrically opposite stop post 122, as illustrated in FIG. 35. When retainer 6 is rotated with column assembly 18, cam 7 will remain stationary until stop lug 150 abuttingly engages stop post 122. In the illustrated example, rotation of approximately 170 degrees from the normal position of slip connector 2 in either the clockwise direction or the counterclockwise direction is required before slip connector 2 rotates as a unit.

Figure 28:
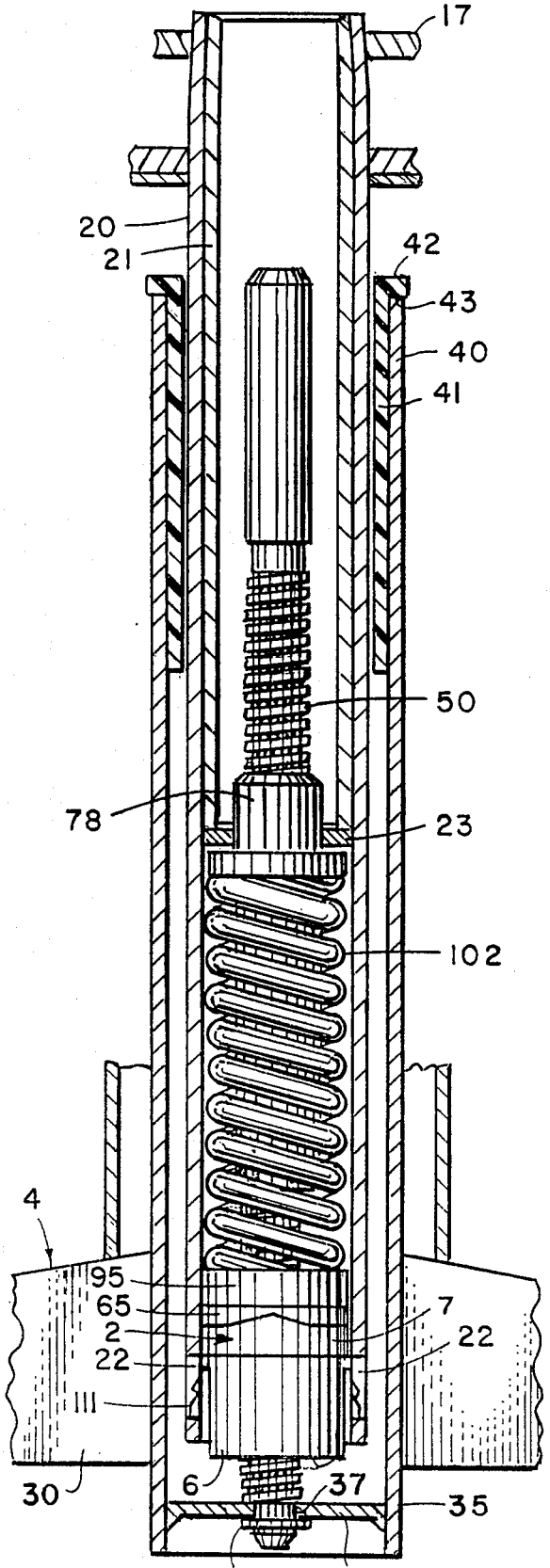
FIG. 28 is a vertical cross-sectional view of a chair base, particularly showing the height adjustor.
Figure 29:
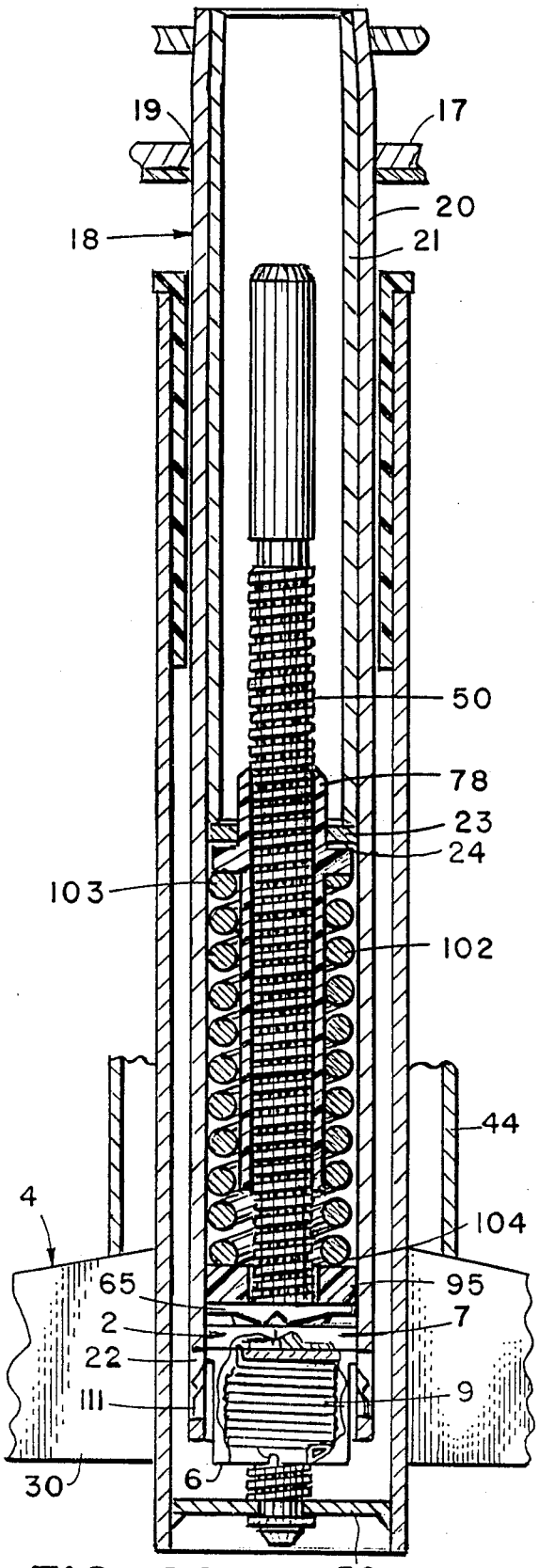
FIG. 29 is a vertical cross-sectional view of the chair base, wherein portions of the slip connector are broken away to reveal internal construction.

As best illustrated in FIGS. 28 and 29, the height adjustor assembly 1 assumes the following configuration when assembled. Adjustment screw 50 is mounted securely on support tube end plate 36, and extends vertically upwardly through the center of support tube 34. Adjustment nut 65 is threadedly mounted on the lower, threaded end 52 of adjustment screw 50, and may rotate thereon to adjust the seat height. Adjustment washer 95 is positioned over adjustment screw 50, and is supported on the upper surface 69 of adjustment nut 65. Spring guide 78 is also positioned on adjustment screw 5, at a location spaced above adjustment washer 95. Bearing 92 is mounted on the upper surface 85 of spring guide collar 84, and slidingly abuts the lower surface 24 of end cap 23 on inner column 21. Coil spring 102 is mounted on adjustment screw 50, and extends between the lower surface 86 of spring guide collar 84 to the upper surface 97 of adjustment washer 95. The lower end 83 of spring guide 78 extends through the center of coil spring 102. Coil spring 102 has an uncompressed length that is greater than the distance between the lower surface 86 of spring guide collar 84, and the lower end 83 of spring guide 78, such that when chair 3 is unoccupied, as illustrated in FIG. 29, coil spring 102 positions the lower end edge 83 of spring guide 78 a spaced apart distance above the upper surface 97 of adjustment washer 95.

In operation, when an average, adult user sits down on chair 3, the weight of the user is transmitted onto spring guide 78, translating the same downwardly along adjustment screw 50, and compressing coil spring 102 somewhat, with the lower end, 82 of spring guide 78 spaced above the upper surface 97 of adjustment washer 95 to provide a spring or cushion feel to the seat. If a preselected overload weight or force, in the nature of 400 pounds, is applied to chair 3, the lower end 82 of spring guide 78 engages the upper surface 97 of adjustment washer 95 to then positively transmit such additional weight or force directly to adjustment nut 65. Coil spring 102 thereby provides a cushioning action that provides the feel of a pneumatic height adjustor, yet achieves positive weight transfer to adjustment nut 65 when heavy loading is applied to the chair 3.

Figure 30:
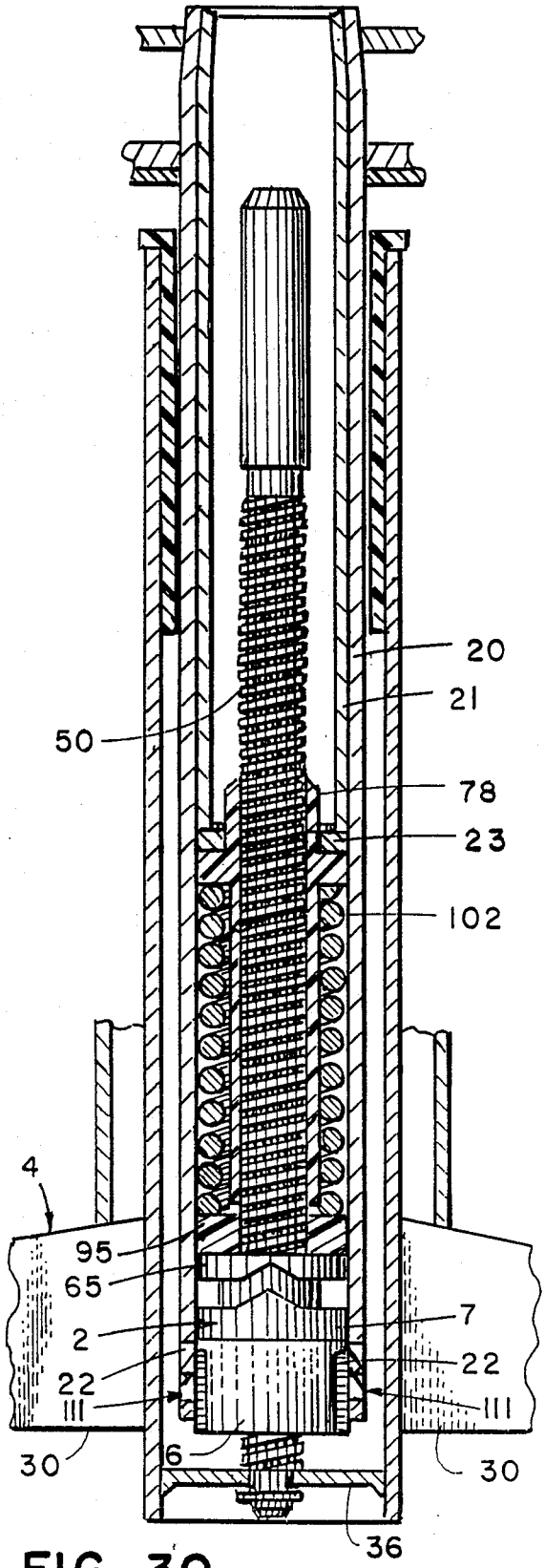
FIG. 30 is a vertical cross-sectional view of the chair base, showing an aligned relationship between the adjustment nut and the cam immediately after a user sits down in the chair.

As the user sits down on chair 3, the downward movement of column assembly 18 and compressing coil 102 also moves slip connector 2 downwardly from adjustment nut 65, as illustrated in FIG. 30. This downward motion disengages the detent teeth 144–145 on cam 7 from the detent grooves 71–72 on adjustment nut 65, thereby permitting rotation of column assembly 18, without rotating adjustment nut 65. Hence, when a user swivels chair 3 about base 4, the selected height setting of the seat 5 will not change.

Figure 31:
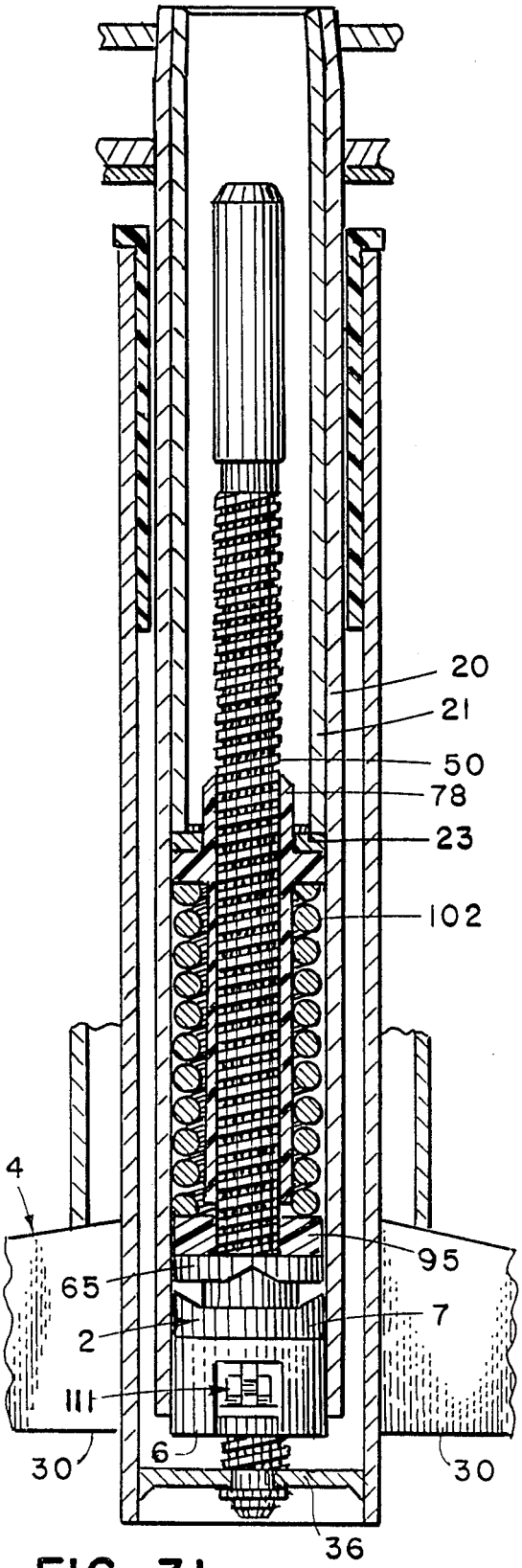
FIG. 31 is a vertical cross-sectional view of the chair base, showing the chair occupied, and the adjustment nut and cam in a misaligned relationship after the chair has been swiveled with respect to the base.

As best illustrated in FIG. 31, the swiveling action of chair 3 about base 4 when the chair is occupied causes the detent teeth 144–145 on cam 7 to become misaligned with the detent grooves 71–72 on adjustment nut 65. Hence, when the user exits the chair, as illustrated in FIG. 32, and coil spring 102 biases spring guide 78 upwardly, along with column assembly 18 to converge slip connector 2 and adjustment nut 65, the detent teeth 144–145 and detent grooves 71–72 will remain misaligned.

To adjust the height of chair 3, the user first exits the chair, and then rotates or swivels the same with respect to base 4 in the direction associated with that change in elevation which the user desires. In the illustrated example, rotation of chair 3 about base 4 in a counterclockwise direction (as viewed in top plan) will raise the elevation of chair 3. Conversely, rotation of chair 3 with respect to base 4 in a clockwise direction (as viewed in top plan) will lower the elevation of chair 3.

Figure 32:
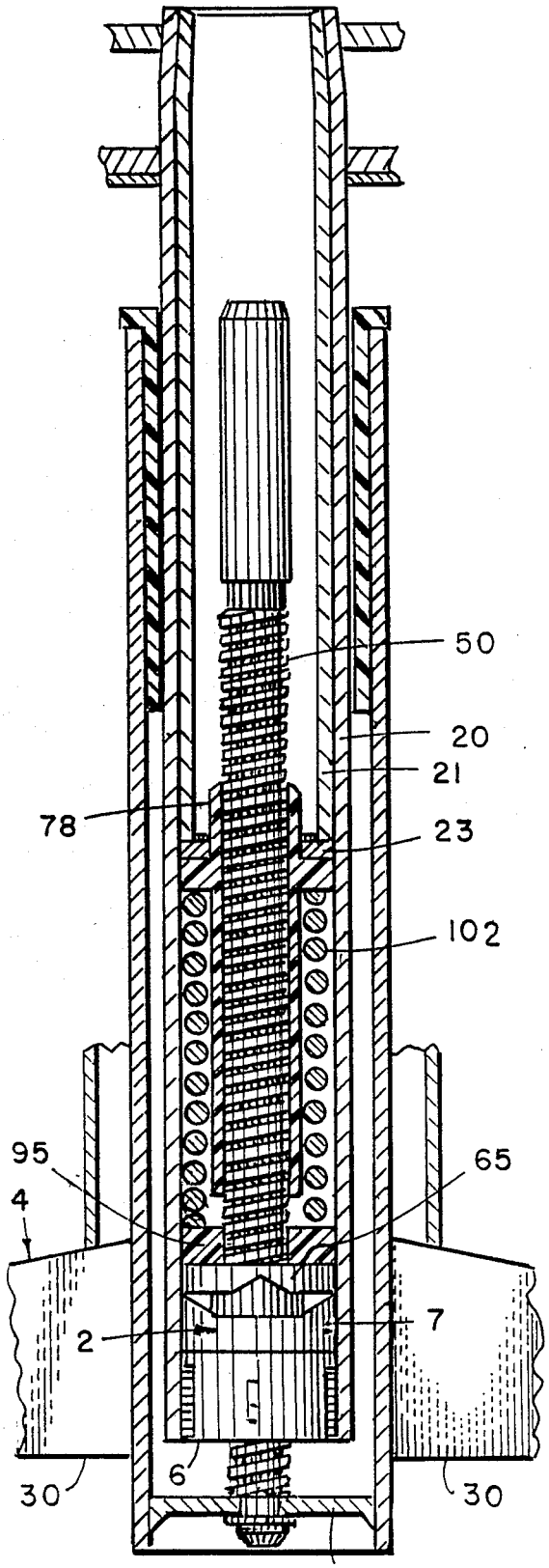
FIG. 32 a vertical cross-sectional view of the chair base, showing the chair in the position illustrated in FIG. 31, but wherein the user has exited the chair.
Figure 33:
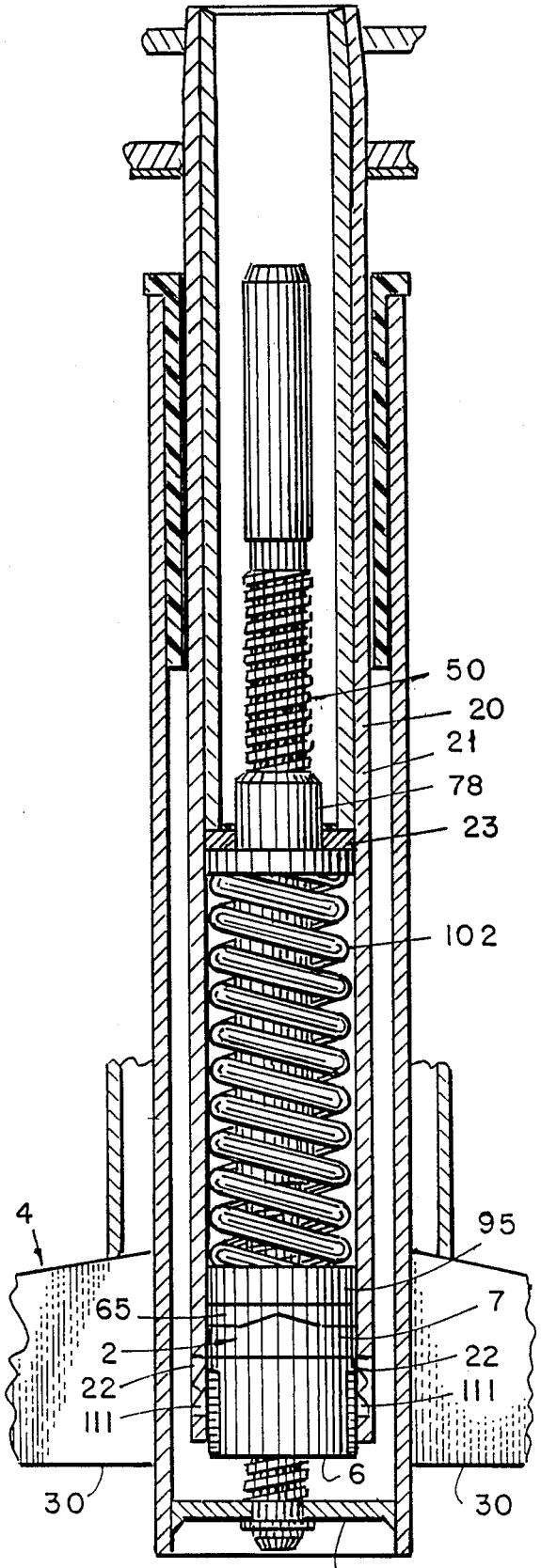
FIG. 33 is a vertical cross-sectional view of the chair base, showing the chair unoccupied, and wherein the chair has been rotated with respect to the base to cause the cam to rotate into alignment with the adjustment nut.
Figure 34:
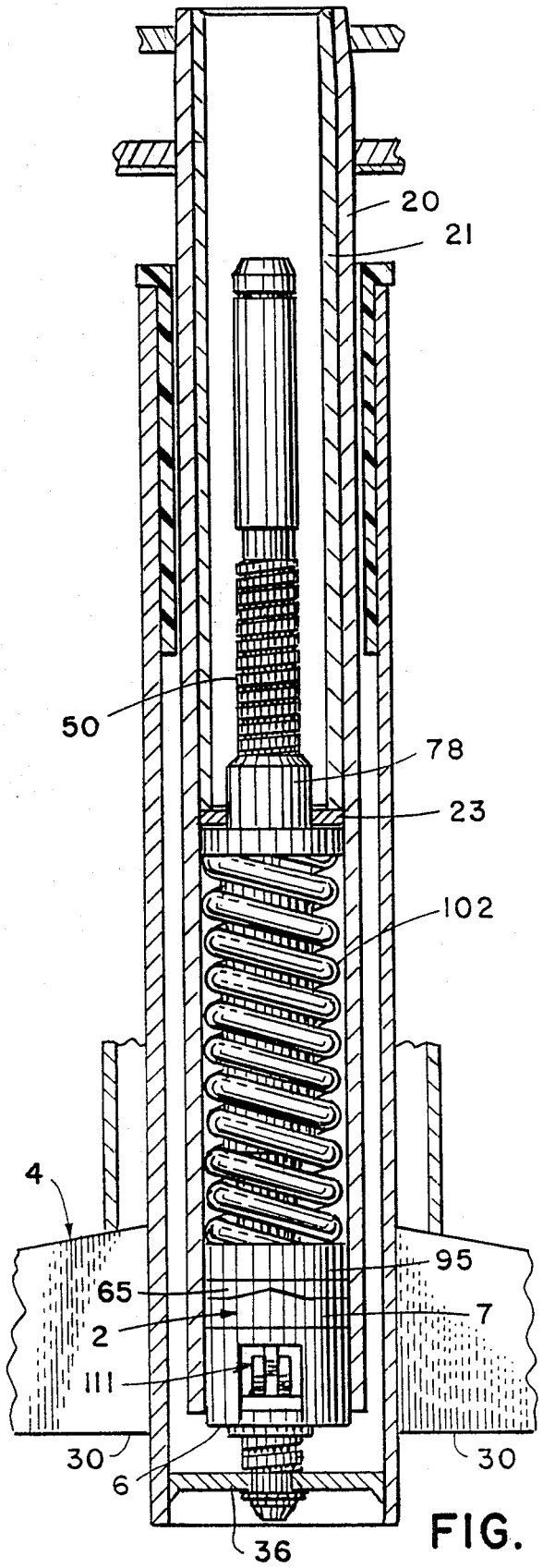
FIG. 34 is a vertical cross-sectional view of the chair base, showing the chair unoccupied, and wherein the chair has been rotated 180 degrees from the position illustrated in FIG. 33 to affect adjustment of the chair height.

With reference to FIGS. 32 and 33, since detent teeth 144–145 and mating detent grooves 71–72 are typically misaligned when the user exits the chair, initial rotation of chair 3 with respect to base 4 is not transmitted to adjustment nut 65, but simply rotates retainer 6 and cam 7 together with respect to adjustment nut 65, until detent teeth 144–145 are aligned with mating detent grooves 71–72. Since detent teeth 144–145 and mating detent grooves 71–72 are arranged diametrically opposite each other, rotation of chair 3 somewhere between 1 degree and approximately 179 degrees will be required to align the same. In the event that detent teeth 144–145 are aligned with mating detent grooves 71–72 when chair 3 is exited, rotation of chair 3 with respect to base 4 will be transmitted directly to cam 7. However, on average, rotation of approximately 90 degrees is required to achieve alignment between detent teeth 144–145 and detent grooves 71–72.

Figure 36:
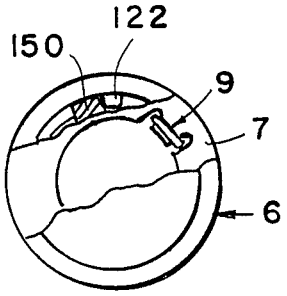
FIG. 36 is a top plan view of the slip connector, wherein portions thereof have been broken away to show the stop portions in a first engaged position.
Figure 37:
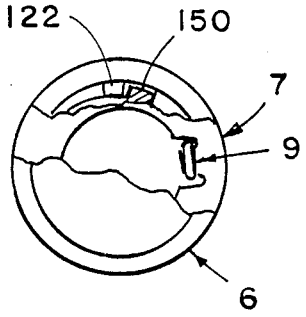
FIG. 37 is a top plan view of the slip connector, with portions thereof broken away to show the stop portions in a second engaged position.

After detent teeth 144–145 and mating detent grooves 71–72 are aligned, adjustment nut 65 and cam 7 will rotate together, and additional rotation of column assembly 18 will continue to rotate retainer 6. However, cam 7 and adjustment nut 65 will not rotate with respect to adjustment screw 50 until the stop post 122 on retainer 6 engages or abuts the stop lug 150 on cam 7, as shown in FIGS. 35–37, which requires approximately 85 degrees of additional rotation, thereby greatly alleviating any unintentional shifting or changes in the selected height setting of chair 3. When stop post 122 does abut either side of stop lug 150, as shown in FIGS. 36 and 37, continued rotation of chair 3 relative to bas 4 will rotate adjustment nut 65 on adjustment screw 50, and thereby raise or lower the height of seat 5. The upper edge of groove 53 on adjustment screw 50 limits the upward adjustment of seat 5, and retains height adjustor 1 in its assembled condition.

It is to be understood that springs 9 and 102 may be selected, along with other design variables, in a manner that will cause engagement between stop lug 150 and stop post 122 before detent teeth 144–145 align with mating detent grooves 71–72. However, rotation of chair 3 with respect to base 4 will not effect the height setting of chair 3 until both stop lug 150 and stop post 122 are engaged, and detent teeth 144–145 are aligned with mating detent grooves 71–72.

When the user again sits down in chair 3, as soon as slip connector 2 disengages from adjustment nut 65, as illustrated in FIG. 30, spring 9 automatically resets, and returns cam 7 to its initial position, wherein stop lug 150 is located diametrically opposite stop post 122, as illustrated in FIG. 35. Hence, chair 3 must be rotated at least 170 degrees, and on average somewhere between 240 and 300 degrees, before such rotation will cause the height of chair 2 to be adjusted or changed.

The slip connector 2 of height adjustor 1 greatly alleviates any unintentional height adjustment of chair 3 due to rotational run-on, or the like. Coil spring 102 and mating spring guide 78 provide a cushioning type of action that provides the feel of a pneumatic height adjustor.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. In combination, a chair having a base, a seat supported thereon, and a height adjustor, comprising:

a threaded spindle supported on said base;

a threaded nut threadedly engaging said spindle and being adjustably supported thereon;

a bearing surface supported on said nut;

a sleeve slidably mounted on said spindle for vertical movement therealong, and including a stop surface which abuts and is supported on said bearing surface when a preselected overload weight is applied to said chair;

a column having an upper end thereof connected with said seat, and a lower end thereof connected with said sleeve;

a spring positioned between said bearing surface and said sleeve, and biasing said seat away from said base when said chair is occupied;

said sleeve and said spring being mutually positioned such that when said chair is occupied by an average user, the stop surface of said sleeve is spaced apart from said bearing surface, and when said preselected overload weight is applied to said chair, said seat moves downwardly to compress said spring and positively support said seat on said base.

2. A chair as set forth in claim 1, wherein:

said spring comprises a coil spring disposed about and generally coaxial with said sleeve.

3. A chair as set forth in claim 2, wherein:

said sleeve includes a generally cylindrically shaped body with a central aperture therein through which said spindle is closely and slidingly received.

4. A chair as set forth in claim 3, wherein:

said sleeve includes an annularly shaped collar disposed adjacent an upper end thereof; and said spring includes an upper end thereof abuttingly engaging said collar.

5. A chair as set forth in claim 4, including:

a washer received over said spindle, disposed between a lower end of said spring and said nut, and including said bearing surface thereon.

6. A chair as set forth in claim 5, wherein:

said column includes an annularly shaped end cap abuttingly engaging an upper surface of said sleeve collar, and permitting rotational motion therebetween when said seat swivels with respect to said base.

7. A chair as set forth in claim 6, including:

a weight actuated mechanism connected with said column and having means for engaging said nut when said seat is unoccupied to raise and lower the height of said seat in response to rotation of said seat with respect to said base, and for disengaging said nut when said seat is occupied to permit said seat to swivel with respect to said base without affecting the height of said seat.

8. A chair as set forth in claim 1, wherein:

said sleeve includes a generally cylindrically shaped body with a central aperture therein through which said spindle is closely and slidingly received.

9. A chair as set forth in claim 1, wherein:

said sleeve includes an annularly shaped collar disposed adjacent an upper end thereof; and said spring includes an upper end thereof abuttingly engaging said collar.

10. A chair as set forth in claim 1, including:

a washer received over said spindle, disposed between a lower end of said spring and said nut, and including said bearing surface thereon.

11. A chair as set forth in claim 1, including:

a weight actuated mechanism connected with said column and having means for engaging said nut when said seat is unoccupied to raise and lower the height of said seat in response to rotation of said seat with respect to said base, and for disengaging said nut when said seat is occupied to permit said seat to swivel with respect to said base without affecting the height of said seat.

* * * * *

UNITED STATES PATENT AND TRADEMARK OFFICE
Certificate

Patent No. 4,872,635

Patented: Oct. 10, 1989

On petition requesting issuance of a certificate for correction of inventorship pursuant to 35 U.S.C. 256, it has been found that the above-identified patent, through error and without any deceptive intent, improperly sets forth the inventorship. Accordingly, it is hereby certified that the correct inventorship of this patent is:
Brian L. Scholten and Charles P. Roossien.

Signed and Sealed this Twenty-fifth Day of December, 1990.

CARL D. FRIEDMAN

*Supervisory Patent Examiner*
*Art Unit 355*